US011713555B2

(12) United States Patent
Raponi

(10) Patent No.: US 11,713,555 B2
(45) Date of Patent: Aug. 1, 2023

(54) RETAINING WALL SYSTEM WITH DEADMAN

(71) Applicant: SUMMA-MAGNA 1 CORPORATION, Martville, NY (US)

(72) Inventor: Gale A. Raponi, Martville, NY (US)

(73) Assignee: SUMMA-MAGNA 1 CORPORATION, Martville, NY (US)

( * ) Notice: Subject to any disclaimer, the term of this patent is extended or adjusted under 35 U.S.C. 154(b) by 0 days.

(21) Appl. No.: 17/501,888

(22) Filed: Oct. 14, 2021

(65) Prior Publication Data

US 2023/0117351 A1 Apr. 20, 2023

(51) Int. Cl.
*E02D 29/02* (2006.01)

(52) U.S. Cl.
CPC ..... *E02D 29/0233* (2013.01); *E02D 29/0266* (2013.01); *E02D 2300/002* (2013.01); *E02D 2300/0034* (2013.01); *E02D 2300/0035* (2013.01); *E02D 2600/30* (2013.01)

(58) Field of Classification Search
CPC .. E02D 29/02; E02D 29/0225; E02D 29/0233
USPC ..... 405/262, 284, 285, 286, 287
See application file for complete search history.

(56) References Cited

U.S. PATENT DOCUMENTS 2,439,606 A * 4/1948 Hurt ..... E02B 3/066 405/285
3,613,382 A * 10/1971 Dickinson ..... E02B 3/066 405/285
3,802,205 A * 4/1974 Dickinson ..... E02D 29/0233 52/592.5
3,922,864 A * 12/1975 Hilfiker ..... E02D 29/02 405/262
4,260,296 A * 4/1981 Hilfiker ..... E02D 29/025 405/287
4,952,098 A * 8/1990 Grayson ..... E02D 29/0233 405/262
5,017,049 A * 5/1991 Sievert ..... B28B 17/0027 405/286
5,368,414 A * 11/1994 Miller ..... E02D 29/0233 405/262
5,468,098 A * 11/1995 Babcock ..... E02D 29/0225 405/262

(Continued)

FOREIGN PATENT DOCUMENTS

CN 110004973 A * 7/2019 ..... E02D 29/0233
CN 111794268 A * 10/2020 ..... E02D 29/0233
KR 2016116601 A * 10/2016 ..... E02D 29/02

*Primary Examiner* — Frederick L Lagman
(74) *Attorney, Agent, or Firm* — Birch, Stewart, Kolasch & Birch, LLP

(57) ABSTRACT

The present invention is directed to a retaining wall system including a retaining wall having with at least one retaining wall rebar extending along a vertical direction, the at least one retaining wall rebar includes an end formed into a first retaining wall rebar hook, at least one deadman spaced from the retaining wall, each deadman including a concrete base extending along the vertical direction, the concrete base including rebar extending past the concrete base and having an end formed into a deadman rebar hook, at least a first hole at a top portion of the retaining wall and extending into the retaining wall to expose the retaining wall rebar hook, and a first cable attached to the retaining wall rebar hook and to the deadman rebar hook to support the retaining wall.

21 Claims, 4 Drawing Sheets

(56) References Cited

U.S. PATENT DOCUMENTS

| | | | | | |
|---|---|---|---|---|---|
| 5,582,492 | A * | 12/1996 | Doyle, Jr. | E02D 29/0233 | 405/262 |
| 5,667,200 | A * | 9/1997 | Kelley, Jr. | E02D 29/025 | 249/177 |
| 6,523,312 | B2 * | 2/2003 | Budge | E04H 17/168 | 52/592.1 |
| 7,037,047 | B1 * | 5/2006 | Tufts | E02D 29/025 | 405/286 |
| 7,114,887 | B1 * | 10/2006 | Rainey | E02D 29/0233 | 405/262 |
| 7,470,093 | B2 * | 12/2008 | Mansfield | E02B 3/066 | 405/15 |
| 7,736,096 | B1 * | 6/2010 | Aaron | E02D 29/02 | 405/286 |
| 7,828,497 | B2 * | 11/2010 | Boxberger | E02D 29/02 | 405/286 |
| 2002/0041796 | A1 * | 4/2002 | Greenberg | E02D 29/0283 | 405/284 |
| 2004/0013474 | A1 * | 1/2004 | Weyant | E02D 5/76 | 405/262 |
| 2007/0122240 | A1 * | 5/2007 | Rainey | E02D 29/0225 | 405/286 |
| 2011/0192097 | A1 * | 8/2011 | Kelley, Jr. | E04C 1/395 | 52/592.5 |

* cited by examiner

RETAINING WALL SYSTEM WITH DEADMAN

BACKGROUND OF THE INVENTION

1. Field of Invention

The present invention is directed to an improved retaining wall design in which at least one deadman is attached to one or more retaining wall blocks by a cable, in order to support the retaining wall and thus improve the load retaining ability of the retaining wall.

2. Description of the Background Art

The prior art method for anchoring a retaining wall, as shown in FIG. 1, includes casting a slab of concrete over the retaining wall and underneath the ground to provide lateral support for the retaining wall. However, this prior art method is tedious, cumbersome and utilizes an unnecessary amount of materials.

SUMMARY OF THE INVENTION

The present invention is directed to an improved retaining wall design, in which at least one deadman, in the form of a concrete column extending in a vertical direction, is attached to a formed retaining wall by a cable, such as a steel cable having a turnbuckle for ensuring proper tension of the cable.

A method of attaching at least one deadman to a retaining wall according to the present invention may include providing a retaining wall including with at least one retaining wall rebar extending in a vertical direction and having an end formed into a retaining wall rebar hook, providing at least one deadman spaced from the retaining wall, each deadman including a concrete base extending in the vertical direction and each concrete base including a deadman rebar extending past the concrete base and having an end formed into a deadman rebar hook, drilling at least a first hole through a top portion of the retaining wall, the at least first hole extending into the retaining wall to expose the retaining wall rebar hook of the at least one retaining wall rebar; and attaching a first cable to the retaining wall rebar hook and to the deadman rebar hook to support the retaining wall.

The cable may be comprised of steel or aluminum and may include a turnbuckle.

The method may further include tightening the turnbuckle in order to increase tension between the retaining wall rebar hook and the deadman rebar hook to support the retaining wall.

The method may further include in response to determining that the deadman has shifted after attaching the retaining wall rebar hook to the deadman rebar hook, tightening the turnbuckle in order to increase tension between the retaining wall rebar hook and the deadman rebar hook to support the retaining wall.

Each rebar of the retaining wall may extend below the retaining wall into soil or aggregate in order to restrict the retaining wall from rotating.

The at least one deadman may include a plurality of deadmen, and the plurality of deadmen may be spaced apart from one another in a longitudinal direction of the retaining wall, the longitudinal direction being perpendicular to the vertical direction.

The retaining wall rebar hook is a first retaining wall rebar hook, and the method may further comprise drilling a second hole through the retaining wall to expose a second retaining wall rebar hook and attaching a second cable to the deadman rebar hook and to the second retaining wall rebar hook.

The first retaining wall rebar hook and the second retaining wall rebar hook may be spaced apart in the vertical direction.

The drilling the at least the first hole may further comprise drilling a plurality of first holes through the top portion of the retaining wall, the plurality of first holes being spaced apart from one another in a longitudinal direction of the retaining wall, and wherein the longitudinal direction is perpendicular to the vertical direction.

The at least one retaining wall rebar includes a plurality of retaining wall rebars spaced apart in the longitudinal direction, the providing the at least one deadman may include providing a plurality of deadmen spaced apart in the longitudinal direction. The first cable may be provided in plurality, and each first cable may extend between a respective one of the retaining wall rebar hooks and a respective one of the deadmen rebar hooks.

A retaining wall system according to the present invention may include a retaining wall including with at least one retaining wall rebar extending along a vertical direction and having an end formed into a first retaining wall rebar hook, at least one deadman spaced from the retaining wall, each deadman including a concrete base extending in the vertical direction and each concrete base including a deadman rebar extending past the concrete base and having an end formed into a deadman rebar hook, at least a first hole at a top portion of the retaining wall and extending into the retaining wall to expose the first retaining wall rebar hook and a first cable attached to the retaining wall rebar hook and to the deadman rebar hook to support the retaining wall.

The cable of the retaining wall system may be comprised of steel, stainless steel, or aluminum and may include a turnbuckle.

The turnbuckle may be configured to be tightened in order to increase tension between the retaining wall rebar hook and the deadman rebar hook to support the retaining wall or to be loosened to reduce the tension between the retaining wall rebar hook and the deadman rebar hook.

Each rebar of the retaining wall may extend below the retaining wall into soil or aggregate in order to restrict the retaining wall from rotating.

The at least deadman may include a plurality of deadmen, and the plurality of deadmen may be spaced apart in a longitudinal direction of the retaining wall.

The retaining wall system may further comprise a second hole through the retaining wall exposing a second retaining wall rebar hook and a second cable attached to the second retaining wall rebar hook and to the deadman rebar hook.

The first retaining wall rebar hook and the second retaining wall rebar hook may be are spaced apart in the vertical direction.

The at least the first hole may include a plurality of first holes extending through the top portion of the retaining wall, the plurality of first holes may be spaced apart from one another along a longitudinal direction of the retaining wall, and the longitudinal direction of the retaining wall is perpendicular to the vertical direction.

The at least one retaining wall rebar may include a plurality of retaining wall rebars spaced apart in the longitudinal axis and the at least one deadman may include a plurality of deadmen spaced apart in the longitudinal axis.

the first cable may be provided in plurality, and each first cable may extend between a respective one of the retaining wall rebar hooks and a respective one of the deadmen rebar hooks.

The retaining wall system may further comprise a second cable attached to a second retaining wall rebar hook and one of the deadmen rebar hooks.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
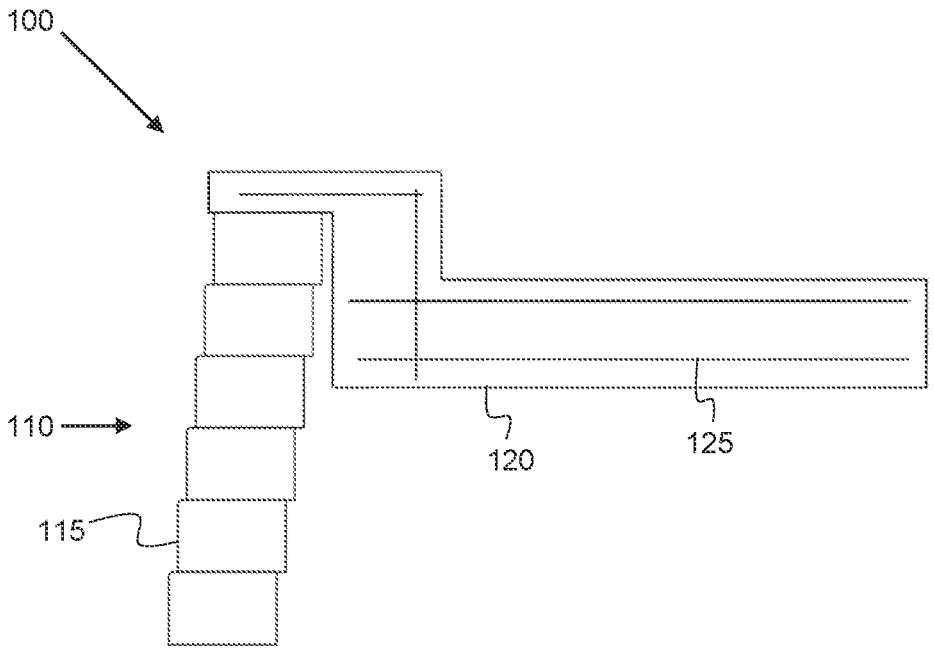
Prior Art FIG. 1
FIG. 1 is a side view of a retaining wall according to the prior art.

The present invention will now be described with reference to the accompanying drawings, wherein the same reference numerals have been used to identify the same or similar elements throughout the several views.

FIG. 1 is a side view of a retaining wall system 100 according to the prior art. After a retaining wall 110 comprised of a plurality of retaining wall blocks 115 is assembled, a slab of concrete, in the form of a deadman 120, is poured horizontally with respect to the vertical extension of the retaining wall 110. In order to pour the slab, a trench is made, for example by digging, and concrete is poured in the slab. The trench may be lined with rebar 125 to reinforce the poured concrete. The slab of concrete is provided to support the retaining wall 110 and may be poured to extend over a top surface of the retaining wall 110, as shown in FIG. 1, or may extend to contact and attach to a horizontal surface of the retaining wall 110. Further, the concrete slab, may be referred to as a cast-in-place slab. This prior art retaining wall system is difficult and time consuming to form and assemble, utilizes an excessive amount of concrete and rebar and disadvantageous because it requires a lot of concrete reinforcement.

Figure 2:
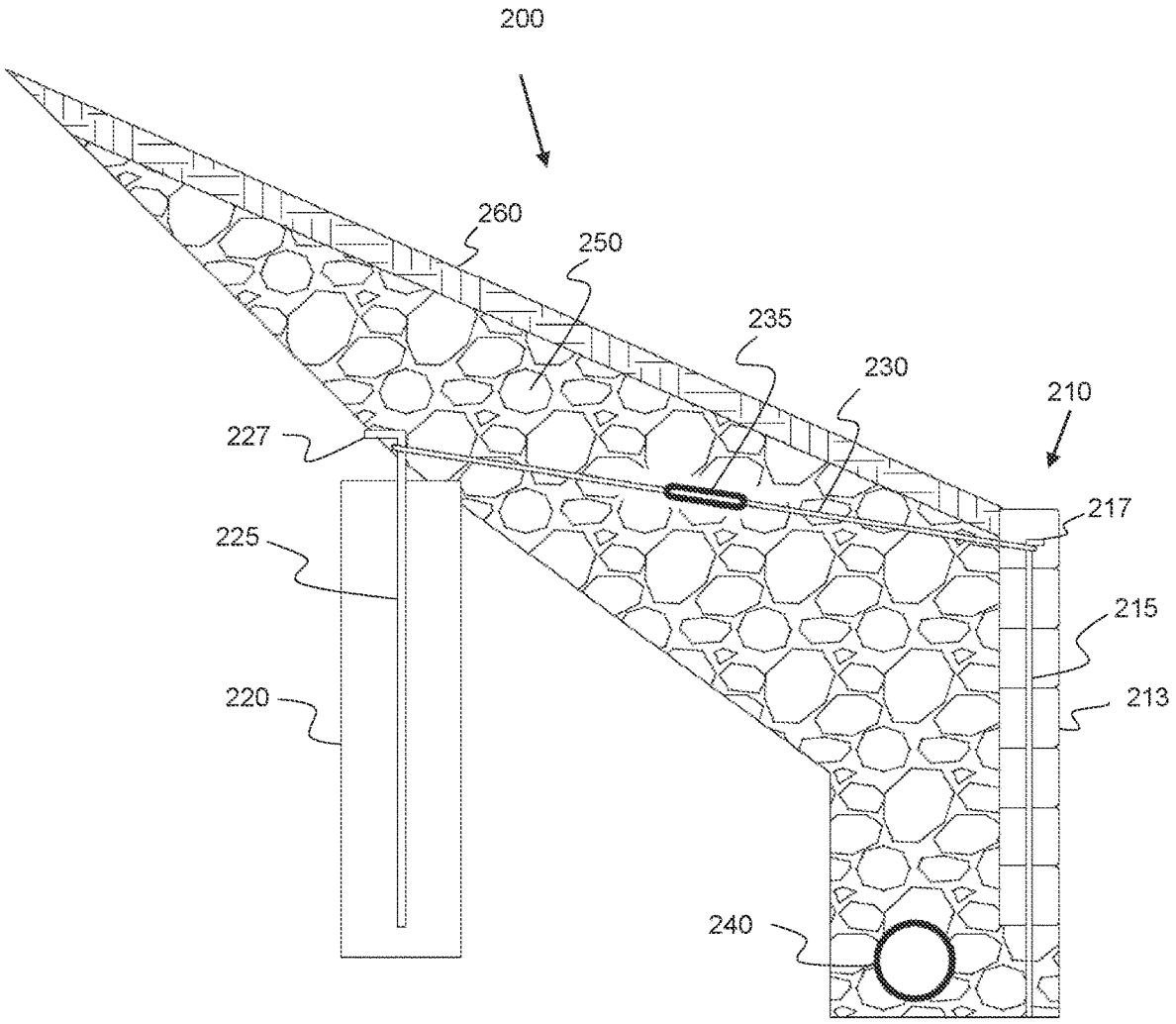
FIG. 2 is a side view of a retaining wall according to an embodiment of the present invention.

FIG. 2 is a side view of a retaining wall system 200 according to an embodiment of the present invention including a retaining wall 210 comprised of a plurality of retaining wall blocks 213. The retaining wall blocks 213 may have one or more rebars 215 (i.e., retaining wall rebar) extending along a vertical axis of the retaining wall 210, and each rebar 215 may extend through a plurality of the retaining wall blocks 213 of the retaining wall 210 and may extend below the retaining all 210 into the base of the retaining wall 210, such as soil or the aggregate 250 (that is, the aggregate pictured below the retaining wall 210 may be replaced with soil). Further, a plurality of rebars 215 may be provided within the retaining wall 210 and may be spaced from each other in a longitudinal axis of the retaining wall 210 and the longitudinal axis may be perpendicular to the vertical axis. The retaining wall 210 may alternatively be in the form of a poured concrete wall or any known retaining wall type.

Each rebar 215 may be bent at a top end thereof into a curved or hook shape to form a retaining wall rebar hook 217, so as to allow for attachment of a cable 230 thereto. Each cable 230 may be comprised of steel, stainless steel, aluminum or any other known material and may be formed into a loop at opposing ends thereof. That is, each cable 230 may include a first end and a second end, and the first end and the second end of each cable may be formed into a loop (e.g., a Flemish eye or eye splice), for instance, by crimping the loop using a metal clasp, or the like. Further, each cable 230 may be provided with a turnbuckle 235, which may be provided at any position along the length of each cable 230, but may preferably be positioned at a center (i.e., longitudinal center) of the cable. Alternatively, the cables 230 need not be provided with a turnbuckle 235 (i.e., stretching screw or bottle screw), or at least one cable 230 may be provided with a turnbuckle 235. The turnbuckle 235 allows for adjusting the tension of the cable 320, which may be necessary after curing of the retaining wall 210 and curing of the deadman 220. For instance, the deadman 220 may shift its position due to natural factors, such as shifting of the soil, thereby lessening the tension of the cable 230 attached thereto at the retaining wall rebar hook 217. The turnbuckle 235 may be replaced with any known device that can be attached to the cable 230 and can increase or decrease tension of the cable.

Further, the retaining wall system 200 of the present invention may include a deadman 220 comprised of concrete base (i.e., concrete cylinder or a concrete in any shape and size) and including a rebar 225 (i.e., a retaining wall rebar) extending through the concrete base to outside of the concrete base and bent to form a deadman rebar hook 227, as illustrated in FIG. 2. A first end of a cable 230 may be attached to the deadman rebar hook 227 and a second end of the cable 230 may be attached to the retaining wall rebar hook 217. The cable 230 is provided with a turnbuckle 235, and a user may tighten or loosen the turnbuckle 235 to increase or decrease the tension between the deadman 220 and the retaining wall 210, respectively. The adjusting of the turnbuckle 235 may take place before or after aggregate 250 and/or soil 260 is filled into a space formed behind the retaining wall 210. That is, construction of the retaining wall 210 may require excavation of the soil behind the retaining wall 210 to allow for the addition of aggregate and other drainage material to drain water away from the retaining wall 210, including to a drain pipe 240 located at a base of the retaining wall 210. Further, if the adjusting of the turnbuckle 235 is done after the space behind the retaining wall 210 is filled, then excavation of the aggregate and/or soil must be performed to access the turnbuckle 235.

One of ordinary skill in the art would recognize that the amount of tension deadman 220 and the retaining wall 210 depends on the desired various characteristics of the retaining wall system 200, such as the dimensions of the retaining wall 210, the potential stresses the retaining wall 210 may be subjected to, the location of the retaining wall 210 and the like.

A method of forming the retaining wall 210 and deadman 220 may include providing a retaining wall 210 including with at least one rebar 215 extending along a vertical axis and having an end formed into a first rebar hook 217, providing at least one deadman 220 spaced from the retaining wall 210, each deadman including a concrete cylinder extending along the vertical axis, the concrete cylinder including a rebar 225 extending past the concrete cylinder and having an end formed into a second rebar hook 227, drilling at least a first hole through a top portion of the retaining wall 210, the at least first hole extending into the retaining wall 210 to expose the first rebar hook 217 of the at least one rebar and attaching a first cable 230 to the first rebar hook 217 and to the second rebar hook 227 to support the retaining wall 210 by providing tension between the retaining wall 210 and the deadman 220.

"Rebar" for purposes of this application is defined as a material, such as a bar (having any shape), that is to be inserted into wet concrete (i.e., concrete that has not yet fully cured, or has only partially cured). The rebar may include at least one or all of the following: one or more ribs, one or more lugs, indentations, one or more hooks and one or more loops. The rebar may be comprised of steel, such as carbon steel, stainless steel, galvanized steel and the like. Further, the rebar may be comprised of steel reinforced with an epoxy resin, glass-fiber reinforced polymer (GFRP), carbon fiber, basalt fiber or the like, but is not limited thereto.

Figure 3:
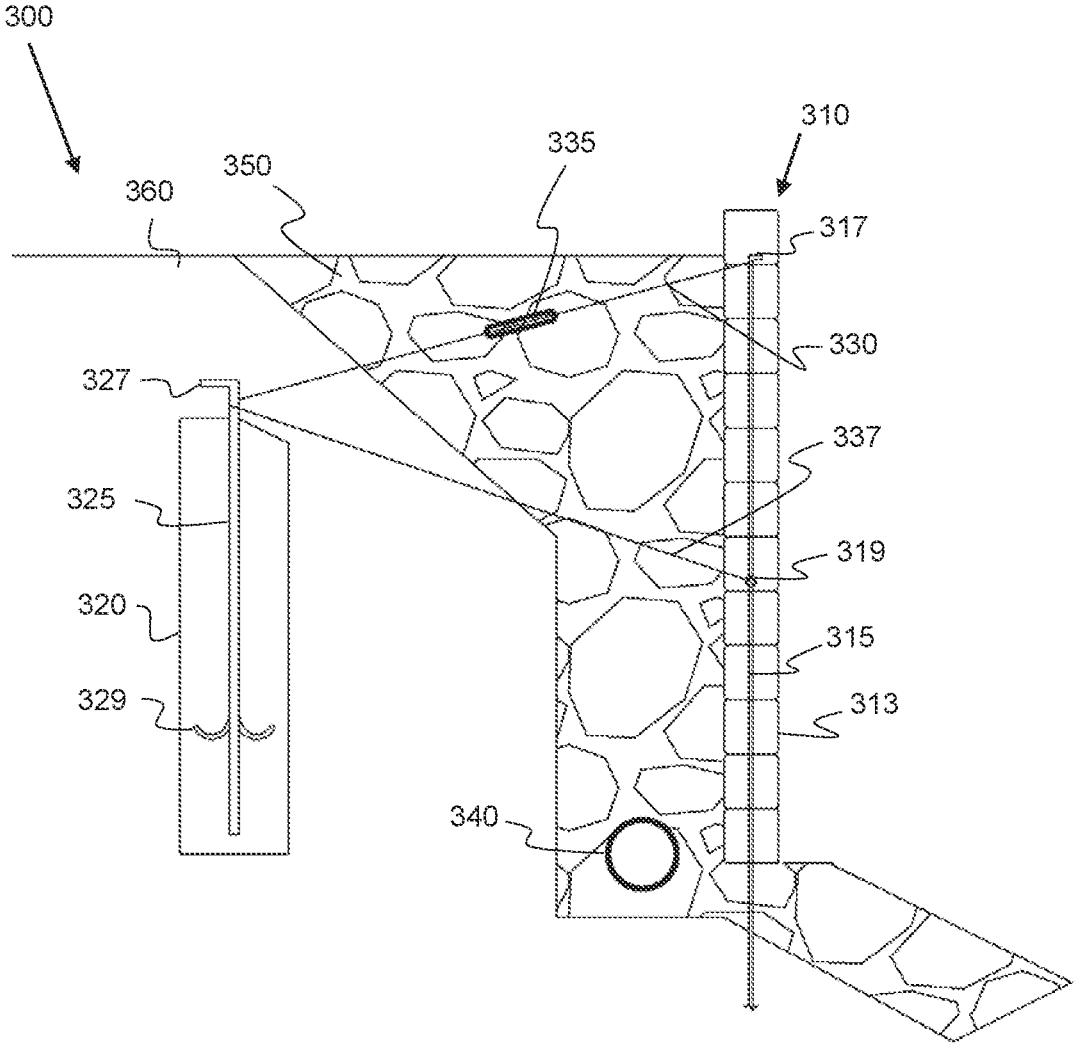
FIG. 3 is a side view of a retaining wall according to an embodiment of the present invention having multiple cables extending at different angles.

Each rebar hook may include at least one of the following: a closed loop, open loop and a bend, each of the closed loop, open loop and the bend being sufficient to retain a cable. Further, each rebar may include a first rebar hook at a first end thereof ending outwardly from the concrete portion (i.e., concrete base) of the deadman and may further include a second rebar hook positioned within the deadman hook. The deadman may include a second rebar hook may be in the form of a j-hook (i.e., "J" shaped hook) or a u-shaped hook that has a concave portion facing a top of the deadman, in order to provide additional strength and support of the rebar into the concrete portion of the deadman. For instance, the second deadman rebar hooks 329 resist upward movement of the rebar with respect to the concrete portion of the deadman, as shown in FIG. 3.

The concrete portion of the deadman 220, 320 may be formed as a cylinder, a parallelogram or any other shape. In order to form the concrete portion, a hole, spaced from the retaining wall 210, is dug, and wet (i.e., uncured) concrete is either directly poured into the hole or a tube form (i.e., Sonotube® or the like) is inserted into the hole and the wet concrete is poured into the tube form to cure. Before the concrete is cured, the rebar is added to the concrete for reinforcement purposes, such as improving tensile strength, as known in the art.

Each cable 230, 330, 337 may be comprised of galvanized steel, stainless steel, or any known metal material.

A drainage pipe 240 may be provided between the retaining wall 210 and the deadman 220 to direct water away from the retaining wall 210. The drainage pipe may be any known type, such as a PVC pipe, a corrugated plastic pipe (i.e., polyethylene pipe), and the like.

FIG. 3 is a side view of a retaining wall system 300 according to an embodiment of the present invention having multiple cables 330, 337 extending at different angles from the deadman rebar hook 327 of the deadman 320 toward a retaining wall 310. The retaining wall system 300, similar to FIG. 2, and is constructed in the same manner as described with respect to FIG. 2 above, requiring the drilling of an additional hole into the retaining wall 310 and the attachment of an additional cable 330, 337 between the retaining wall 310 and the deadman 320 (i.e., the rebar hook 327 of the deadman 320).

The retaining wall system 300 includes a retaining wall 310, a deadman 320 and at least two cables 330, 337 extending between the deadman 320 and the retaining wall 310. Aggregate 350 is provided between the deadman 320 and the retaining wall 310 for drainage, as known in the art. Further, the deadman 320 is formed into soil 360, as described above with respect to FIG. 2. Lastly, the retaining wall system 300 includes one or more drainage pipes 340 to drain any excess water away from the retaining wall 310. Each deadman 320 may be additionally provided with one or more rebar J-hooks, or the like, for added vertical stability and strength.

Further, the retaining wall 310 may be comprised of a plurality of retaining wall blocks 313 and may include at least one rebar (retaining wall rebar) 315 extending vertically through the retaining wall 310 to provide additional strength and support. The retaining wall 310 may further include a retaining wall rebar first hook 317 for connection to the first cable 330 and a retaining wall rebar second hook 319 for connection to the second cable 337. As shown in FIG. 3, each deadman rebar hook 327 may be attached to a first cable 330 at a first end of the first cable 330 and attached to a second cable 337 at a first end of the second cable 337. A second end of the first cable 300 may be attached a rebar hook 317 (i.e., retaining wall first rebar hook) of the respective rebar 315 of the retaining wall 310 at a first height, and a second end of the second cable 337 may be attached to the respective rebar 315 at a second height different from the first height. The second end of the second cable 337 may be attached to another rebar 315 (i.e., the retaining wall second rebar hook 319), or may be wrapped around the respective rebar 315, or may otherwise be attached. Each of the plurality of cables 330, 337 attached to the each deadman 320 may be provided with a turnbuckle 335, or alternatively, only the first cable 330 may be provided with a turnbuckle 335.

Figure 4:
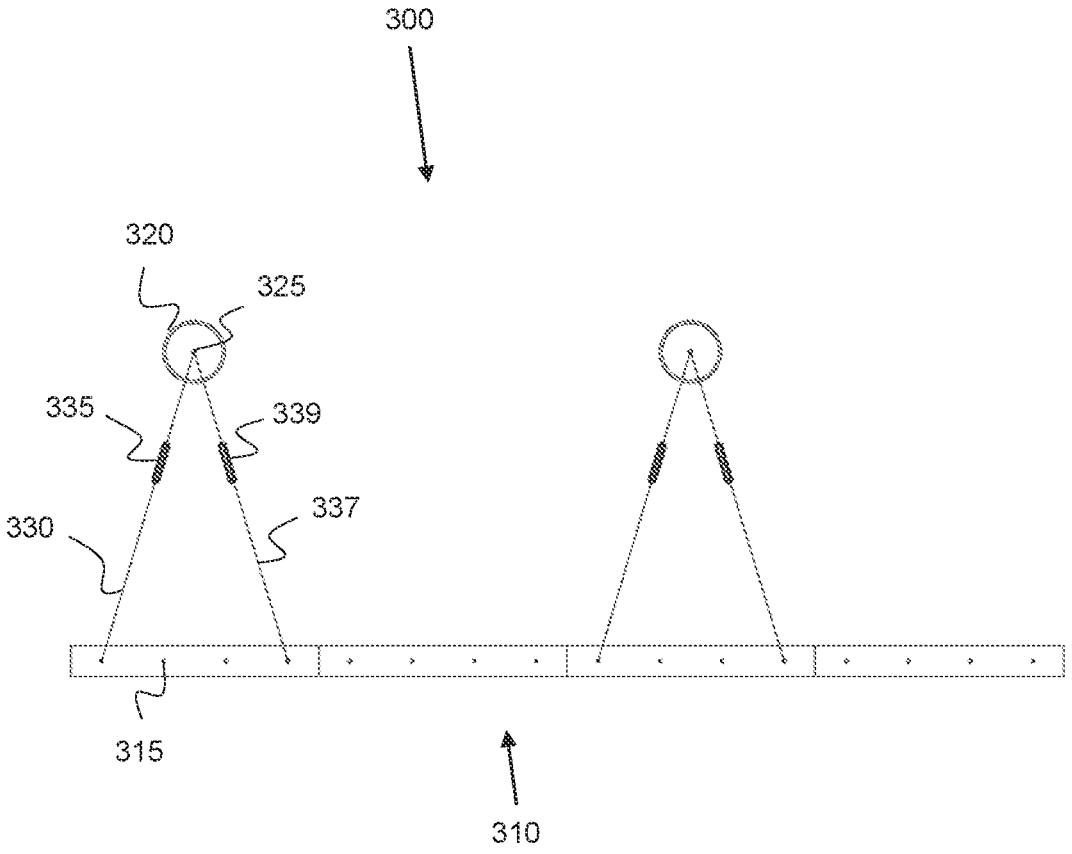
FIG. 4 is a top view of a retaining wall according to an embodiment of the present invention.

If the retaining wall system 300 includes a plurality of deadmen 320, each deadman 320 may be attached to multiple cables 330, 337 (e.g., any number of cables that are attached to the retaining wall 310 at different locations so as to be spaced apart from one another), as set forth above and shown in FIGS. 3 and 4, or less than each deadman 320 may be attached to multiple cables 330, 337.

One of ordinary skill in the art would understand the number of cables and the location of the cables will be determined based on design constraints and structural requirements, that are different for different types and sizes of retaining walls, including the location of the retaining wall, the soil composition, and the like.

FIG. 4 is a top view of a retaining wall system 300 of FIG. 3 according to an embodiment of the present invention. FIG. 4 illustrates two deadmen 320, with each being attached to the retaining wall 310 via multiple cables 330, 337, and each cable 330, 337 is provided with a turnbuckle 335, 339. The cables 330, 337 may be spaced apart from one another by a predetermined distance to ensure an even distribution of tensile force applied to the retaining wall 310 in order to support the retaining wall 310 against the soil and/or aggregate being retained by the retaining wall 310. Further, the retaining wall 310 may be provided with a plurality of rebars 317 (i.e., retaining wall rebars) that are spaced apart in a longitudinal direction of the retaining wall.

Each deadman 320 may be spaced apart from one another at any distance sufficient to provide support to the retaining wall 310 via the one or more cables 330, 337. Further, the one or more cables 330, 337 may be attached to any of the rebars 315 of the retaining wall 310.

The disclosure of which described above is not limited to the materials and features described therein, and may be changed within the scope of one ordinary skill in the art.

What is claimed is:

1. A method of attaching at least one deadman to a retaining wall, comprising:

providing a retaining wall including with at least one retaining wall rebar extending in a vertical direction and having an end formed into a retaining wall rebar hook;

providing at least one deadman spaced from the retaining wall, each deadman including a concrete base extending in the vertical direction and each concrete base including a deadman rebar extending past the concrete base and having an end formed into a deadman rebar hook;

drilling at least a first hole through a top portion of the retaining wall, the at least first hole extending into the retaining wall to expose the retaining wall rebar hook of the at least one retaining wall rebar; and attaching a first cable to the retaining wall rebar hook and to the deadman rebar hook to support the retaining wall, wherein each retaining wall rebar extends below the retaining wall into soil or aggregate in order to restrict the retaining wall from rotating.

2. The method of claim 1, wherein the first cable is comprised of steel, stainless steel or aluminum and includes a turnbuckle.

3. The method of claim 2, further comprising tightening the turnbuckle in order to increase tension between the retaining wall rebar hook and the deadman rebar hook to support the retaining wall.

4. The method of claim 2, further comprising in response to determining that the deadman has shifted after attaching the first cable to the retaining wall rebar hook and to the deadman rebar hook, tightening the turnbuckle in order to increase tension between the retaining wall rebar hook and the deadman rebar hook to support the retaining wall.

5. The method of claim 1, wherein the at least one deadman includes a plurality of deadmen, and wherein the plurality of deadmen are spaced apart from one another in a longitudinal direction of the retaining wall, the longitudinal direction being perpendicular to the vertical direction.

6. The method of claim 1, wherein the retaining wall rebar hook is a first retaining wall rebar hook, and wherein the method further comprises:

drilling a second hole through the retaining wall to expose a second retaining wall rebar hook; and attaching a second cable to the deadman rebar hook and to the second retaining wall rebar hook.

7. The method of claim 1, wherein the drilling the at least the first hole further comprises drilling a plurality of first holes through the top portion of the retaining wall, the plurality of first holes being spaced apart from one another in a longitudinal direction of the retaining wall, and wherein the longitudinal direction is perpendicular to the vertical direction.

8. The method of claim 7, wherein the at least one retaining wall rebar includes a plurality of retaining wall rebars spaced apart in the longitudinal direction, wherein the providing the at least one deadman includes providing a plurality of deadmen spaced apart in the longitudinal direction, wherein the first cable is among a plurality of cables, and wherein each cable extends between a respective one of the retaining wall rebar hooks and a respective one of the deadmen rebar hooks.

9. A method of attaching at least one deadman to a retaining wall, comprising:

providing a retaining wall including with at least one retaining wall rebar extending in a vertical direction and having an end formed into a retaining wall rebar hook;

providing at least one deadman spaced from the retaining wall, each deadman including a concrete base extending in the vertical direction and each concrete base including a deadman rebar extending past the concrete base and having an end formed into a deadman rebar hook;

drilling at least a first hole through a top portion of the retaining wall, the at least first hole extending into the retaining wall to expose the retaining wall rebar hook of the at least one retaining wall rebar; and attaching a first cable to the retaining wall rebar hook and to the deadman rebar hook to support the retaining wall, wherein the retaining wall rebar hook is a first retaining wall rebar hook, wherein the method further comprises:

drilling a second hole through the retaining wall to expose a second retaining wall rebar hook; and attaching a second cable to the deadman rebar hook and to the second retaining wall rebar hook, and wherein the first retaining wall rebar hook and the second retaining wall rebar hook are spaced apart in the vertical direction.

10. A retaining wall system, including:

a retaining wall including with at least one retaining wall rebar extending along a vertical direction and having an end formed into a first retaining wall rebar hook;

at least one deadman spaced from the retaining wall, each deadman including a concrete base extending in the vertical direction and each concrete base including a deadman rebar extending past the concrete base and having an end formed into a deadman rebar hook;

at least a first hole located at a top portion of the retaining wall and extending into the retaining wall to expose the first retaining wall rebar hook; and a first cable attached to the retaining wall rebar hook and to the deadman rebar hook to support the retaining wall, wherein each retaining wall rebar extends below the retaining wall into soil or aggregate in order to restrict the retaining wall from rotating.

11. The retaining wall system of claim 10, wherein the first cable is comprised of steel, stainless steel or aluminum and includes a turnbuckle.

12. The retaining wall system of claim 11, wherein the turnbuckle configured to be tightened in order to increase tension between the retaining wall rebar hook and the deadman rebar hook or to be loosened to reduce the tension between the retaining wall rebar hook and the deadman rebar hook.

13. The retaining wall system of claim 10, wherein the at least deadman includes a plurality of deadmen, and wherein the plurality of deadmen are spaced apart in a longitudinal direction of the retaining wall.

14. The retaining wall system of claim 10, further comprising a second hole through the retaining wall exposing a second retaining wall rebar hook; and a second cable attached to the second retaining wall rebar hook and to the deadman rebar hook.

15. The retaining wall system of claim 10, wherein the at least the first hole includes a plurality of first holes extending through the top portion of the retaining wall, the plurality of first holes being spaced apart from one another along a longitudinal direction of the retaining wall, and wherein the longitudinal direction of the retaining wall is perpendicular to the vertical direction.

16. The retaining wall system of claim 15, wherein the at least one retaining wall rebar includes a plurality of retaining wall rebars spaced apart in the longitudinal axis, wherein the at least one deadman includes a plurality of deadmen spaced apart in the longitudinal axis, wherein the first cable is among a plurality of cables, and wherein each cable extends between a respective one of the retaining wall rebar hooks and a respective one of the deadmen rebar hooks.

17. The retaining wall system of claim 16, wherein a first deadman among the plurality of deadmen is attached to two cables among the plurality of cables via the respective deadman rebar hook, the two cables being attached to different portions of the retaining wall.

18. A retaining wall system, including:

a retaining wall including with at least one retaining wall rebar extending along a vertical direction and having an end formed into a first retaining wall rebar hook;

at least one deadman spaced from the retaining wall, each deadman including a concrete base extending in the vertical direction and each concrete base including a deadman rebar extending past the concrete base and having an end formed into a deadman rebar hook;

at least a first hole located at a top portion of the retaining wall and extending into the retaining wall to expose the first retaining wall rebar hook;

a first cable attached to the retaining wall rebar hook and to the deadman rebar hook to support the retaining wall;

a second hole through the retaining wall exposing a second retaining wall rebar hook; and a second cable attached to the second retaining wall rebar hook and to the deadman rebar hook, wherein the first retaining wall rebar hook and the second retaining wall rebar hook are spaced apart in the vertical direction.

19. A retaining wall system, including:

a retaining wall including with a retaining wall rebar extending along a vertical direction and having an end formed into a first retaining wall rebar hook;

a deadman spaced from the retaining wall, the deadman including a concrete base extending in the vertical direction, the concrete base including a deadman rebar extending past the concrete base and having an end formed into a deadman rebar hook;

a first hole located at a top portion of the retaining wall and extending into the retaining wall to expose the first retaining wall rebar hook; and a first cable attached to the retaining wall rebar hook and to the deadman rebar hook to support the retaining wall, wherein at least a portion of the deadman is positioned higher than a top surface of the retaining wall and the first cable extends upwards in the vertical direction from retaining wall rebar hook to the deadman rebar hook, or wherein at least a portion of the deadman is positioned lower than a top surface of the retaining wall and the first cable extends upwards in the vertical direction from retaining wall rebar hook to the deadman rebar hook.

20. The retaining wall system of claim 19, wherein when the first cable is attached to the retaining wall rebar hook at two vertically spaced locations.

21. The retaining wall system of claim 20, wherein the first cable includes a turnbuckle to modify a tension of the cable.

* * * * *